US011202345B2

(12) United States Patent
Heo et al.

(10) Patent No.: US 11,202,345 B2
(45) **Date of Patent: *Dec. 14, 2021**

(54) LOADED-OBJECT SENSOR AND INDUCTION HEATING DEVICE INCLUDING LOADED-OBJECT SENSOR

(71) Applicant: LG ELECTRONICS INC., Seoul (KR)

(72) Inventors: Jea Shik Heo, Seoul (KR); Byeong Geuk Kang, Seoul (KR); Ho Yong Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 260 days.

This patent is subject to a terminal disclaimer.

(21) Appl. No.: 16/018,203

(22) Filed: Jun. 26, 2018

(65) Prior Publication Data

US 2018/0376540 A1 Dec. 27, 2018

(30) Foreign Application Priority Data

Jun. 26, 2017 (KR) ..... 10-2017-0080805

(51) Int. Cl.
*H05B 6/06* (2006.01)
*H05B 1/02* (2006.01)
*H05B 6/12* (2006.01)

(52) U.S. Cl.
CPC ..... *H05B 6/062* (2013.01); *H05B 1/0266* (2013.01); *H05B 6/1236* (2013.01); (Continued)

(58) Field of Classification Search
CPC ..... H05B 2213/05; H05B 2213/07; H05B 6/062; H05B 6/065; H05B 6/1272; H05B 6/1209; H05B 2206/022
See application file for complete search history.

(56) References Cited

U.S. PATENT DOCUMENTS 5,296,684 A * 3/1994 Essig ..... H05B 3/746 219/518
5,877,625 A * 3/1999 Togo ..... G01R 33/02 324/174

(Continued)

FOREIGN PATENT DOCUMENTS

EP 2 312 908 4/2011
EP 2 981 154 2/2016

(Continued)

OTHER PUBLICATIONS

European Search Report dated Nov. 14, 2018 issued in Application No. 18179855.4.

(Continued)

*Primary Examiner* — Ibrahime A Abraham
*Assistant Examiner* — Joe E Mills, Jr.
(74) *Attorney, Agent, or Firm* — Ked & Associates LLP

(57) ABSTRACT

The present disclosure relates to a loaded-object sensor and an induction heating device including the loaded-object sensor. The loaded-object sensor has a cylindrical hollow body with a sensing coil wound on its outer surface. Further, a receiving space formed inside the body of the loaded-object sensor accommodates a temperature sensor. The loaded-object sensor is concentrically provided in a central region of the working coil. The sensor may measure the temperature of the loaded object while discriminating a type of the loaded object placed on a corresponding position to the working coil.

20 Claims, 7 Drawing Sheets

(52) U.S. Cl.
CPC ..... *H05B 6/1245* (2013.01); *H05B 2213/05* (2013.01); *H05B 2213/07* (2013.01)

(56) References Cited

U.S. PATENT DOCUMENTS

| | | | | |
|---|---|---|---|---|
| 2015/0357893 | A1* | 12/2015 | Deak, Sr. ..... | H02K 35/06<br>310/38 |
| 2016/0150600 | A1 | 5/2016 | Lomp et al. | |
| 2018/0025838 | A1* | 1/2018 | Som ..... | H02J 50/10<br>361/143 |

FOREIGN PATENT DOCUMENTS

| | | |
|---|---|---|
| EP | 3 026 981 | 6/2016 |
| JP | 06-78833 | 11/1994 |
| JP | 6038345 | 12/2016 |
| KR | 10-2014-0131118 | 11/2014 |

OTHER PUBLICATIONS

Korean Office Action dated Apr. 5, 2019 issued in KR Application No. 10-2017-0080805.

* cited by examiner

LOADED-OBJECT SENSOR AND INDUCTION HEATING DEVICE INCLUDING LOADED-OBJECT SENSOR

CROSS-REFERENCE TO RELATED APPLICATION

This application claims priority under 35 U.S.C. § 119 to Korean Application No. 10-2017-0080805, filed on Jun. 26, 2017, whose entire disclosure is hereby incorporated by reference.

BACKGROUND

1. Field

The present disclosure relates to an induction heating device.

2. Background

In homes and restaurants, cooking appliances may use various heating methods to heat a cooking vessel, such as a pot. Gas ranges, stoves, or other cookers may use synthetic gas (syngas), natural gas, propane, butane, liquefied petroleum gas or other flammable gas as a fuel source. Other types of cooking devices may heat a cooking vessel using electricity.

Cooking devices using electricity-based heating may be generally categorized as resistive-type heating devices or inductive-type heating devices. In the electrical resistive heating devices, heat may be generated when current flows through a metal resistance wire or a non-metallic heating element, such as silicon carbide, and this heat from the heated element may be transmitted to an object through radiation or conduction to heat the object. As described in greater detail below, the inductive heating devices may apply a high-frequency power of a predetermined magnitude to a working coil, such as a copper coil, to generate a magnetic field around the working coil, and magnetic induction from the magnetic field may cause an eddy current to be generated in an adjacent pot made of a certain metals so that the pot itself is heated due to electrical resistance from the eddy current.

In greater detail, the principles of the induction heating scheme includes applying a high-frequency voltage (e.g., an alternating current) of a predetermined magnitude to the working coil. Accordingly, an inductive magnetic field is generated around the working coil. When a pot containing certain metals is positioned on or near the working coil to receive the flux of the generated inductive magnetic field, an eddy current is generated inside a portion of the pot. As the resulting eddy current flows within the pot, the pot itself is heated while the induction heating device remains relatively cool.

In this way, activation of the inductively-heated device causes the pot and not the loading plate of the inductively-heated device to be heated. When the pot is lifted from the loading plate of the induction heating device and away from the inductive magnetic field around the coil, the pot immediately ceases to be additionally heated since the eddy current is no longer being generated. Since the working coil in the induction heating device is not heated, the temperature of the loading plate remains at a relatively low temperature even during cooking, and the loading plate remains relatively safe to contact by a user. Also, by remaining relatively cool, the loading plate is easy to clean since spilled food items will not burn on the cool loading plate.

Furthermore, since the induction heating device heats only the pot itself by inductive heating and does not heat the loading plate or other component of the induction heating device, the induction heating device is advantageously more energy-efficient in comparison to the gas-range or the resistance heating electrical device. Another advantage of an inductively-heated device is that it heats pots relatively faster than other types of heating devices, and the pot may be heated on the induction heating device at a speed that directly varies based on the applied magnitude of the induction heating device, such that the amount and speed of the induction heating may be carefully controlled through control of the applied induction current.

However, there is a limitation that only pots including certain types of materials, such as ferric metals, may be used on the induction heating device. As previously described, only a pot or other object in which the eddy current is generated when positioned near the magnetic field from the working coil may be used on the induction heating device. Because of this constraint, it may be helpful to consumers for the induction heater to accurately determine whether a pot or other object placed on the induction heating device may be heated via the magnetic induction.

In certain induction heating devices, a predetermined amount of power may be supplied to the working coil for a predetermined time, to determine whether the eddy current occurs in the pot. The induction heating devices may then determine, based on whether the eddy current occurs in the pot, whether the pot is suitable for induction heating. However, according to this method, relatively high levels of power (for example, 200 W or more) may be used to determine the suitability of the pot for induction heating. Accordingly, an improved induction heating device could accurately and quickly determine whether a pot is compatible with induction heating while consuming less power.

BRIEF DESCRIPTION OF THE DRAWINGS

The embodiments will be described in detail with reference to the following drawings in which like reference numerals refer to like elements wherein.

DETAILED DESCRIPTION

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

Figure 1:
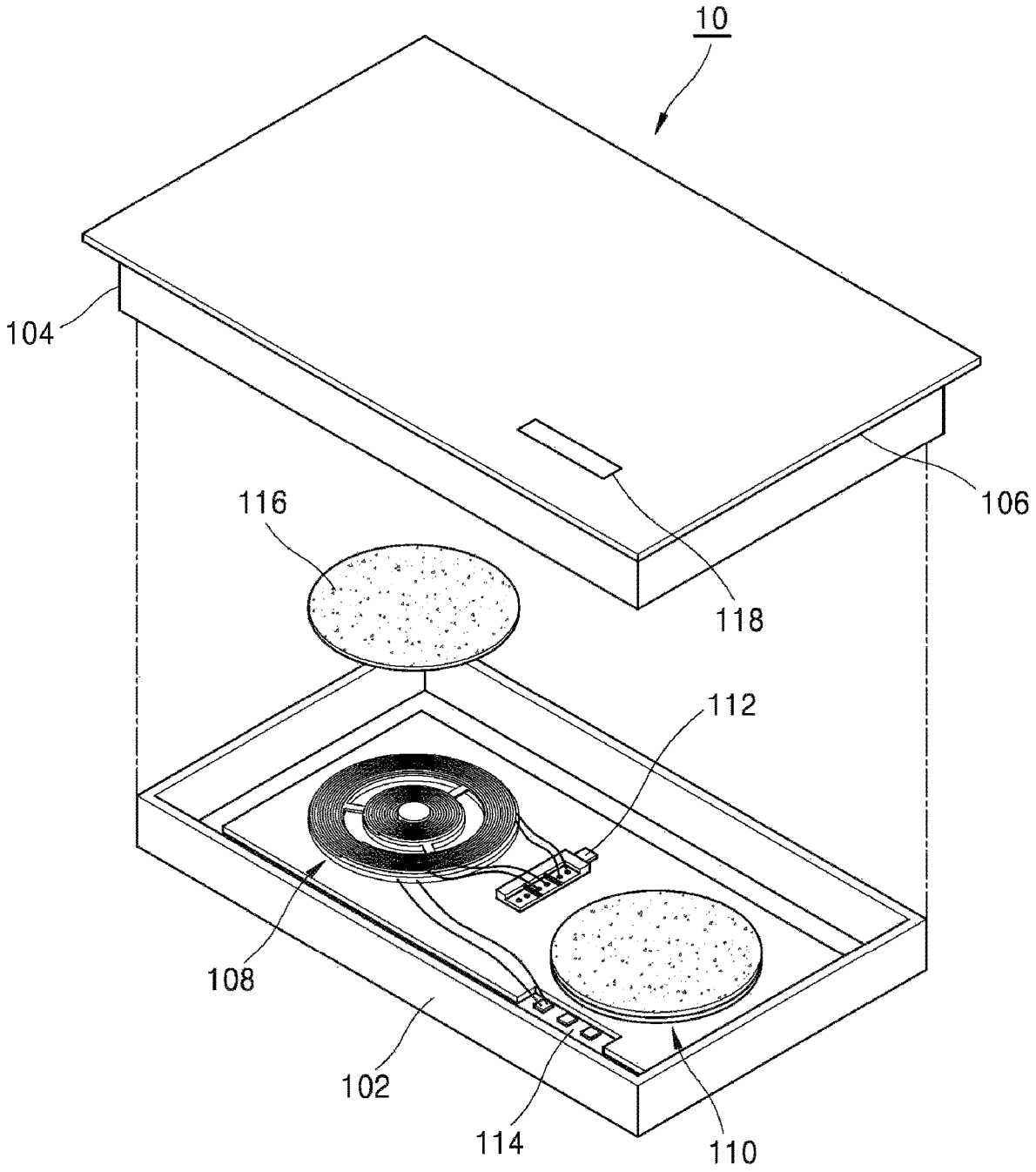
FIG. 1 is a schematic representation of an induction heating device according to one embodiment of the present disclosure.

FIG. 1 is a schematic representation of an inductively-heated device 10 according to one embodiment of the present disclosure. Referring to FIG. 1, an induction heating device (also referred to as an induction stove or induction hob) 10 according to one embodiment of the present disclosure may include a casing 102 constituting a main body or outer appearance of the induction heating device 10, and a cover plate 104 coupled to the casing 102 to seal the casing 102.

The cover plate 104 may be coupled to a top face of the casing 102 to seal a space defined inside the casing 102 from the outside. The cover plate 104 may include a loading plate 106 on which a user may selectively place an object to be heated through inductive magnetic flux. As used herein, the phrase "loaded object" generally refers to a cooking vessel, such as pan or pot, positioned on the loading plate 106. In one embodiment of the present disclosure, the loading plate 106 may be made of a tempered glass material, such as ceramic glass.

Referring again to FIG. 1, one or more working coil assemblies 108, 110 to heat the loaded object may be provided in a space formed inside the casing 102. Furthermore, the interior of the casing 102 may also include an interface 114 that allows a user to control the induction heating device 10 to apply power, allows the user to control the output of the working coil assembles 108 and 110, and that displays information related to a status of the induction heating device 10. The interface 114 may include a touch panel capable of both information display and information input via touch. However, the present disclosure is not limited thereto, and depending on the embodiment, an interface 114 may include a keyboard, trackball, joystick, buttons, switches, knobs, dials, or other different input devices to receive a user input may be used. Furthermore, the interface 114 may include one or more sensors, such as a microphone to detect audio input by the user and/or a camera to detect motions by the user, and a processor to interpret the captured sensor data to identify the user input.

Furthermore, the loading plate 106 may include a manipulation region (or interface cover) 118 provided at a position corresponding to the interface 114. To direct input by the user, the manipulation region 118 may be pre-printed with characters, images, or the like. The user may perform a desired manipulation by touching a specific point in the manipulation region 118 corresponding to the preprinted character or image. Further, the information output by the interface 114 may be displayed through the loading plate 106.

Further, in the space formed inside the casing 102, a power supply 112 to supply power to the working coil assemblies 108, 110 and/or the interface 114 may be provided. For example, the power supply 112 may be coupled to a commercial power supply and may include one or more components that convert the commercial power for use by the working coil assemblies 108, 110 and/or the interface 114.

In the embodiment of FIG. 1, the two working coil assemblies 108 and 110 are shown inside the casing 102. It should be appreciated, however, that the induction heating device 10 may include any number of working coil assemblies 108, 110. For example, in other embodiments of the present disclosure, the induction heating device 10 may include one working coil assembly 108 or 110 within the casing 102, or may include three or more working coil assemblies 108, 110.

Each of the working coil assemblies 108 and 110 may include a working coil that generates an inductive magnetic field using a high frequency alternating current supplied thereto by a power supply 112, and a thermal insulating sheet 116 to protect the working coil from heat generated by the loaded object on the cover plate. In certain embodiments of the induction heating device 10, the thermal insulating sheet 116 may be omitted.

Although not shown in FIG. 1, a control unit (such as control unit 602 in FIG. 6), also referred to herein as a controller or processor, may be provided in the space formed inside the casing 102. The control unit may receive a user command via the interface 114 and may control the power supply 112 to activate or deactivate the power supply to the working coil assembly 108, 110 based on the user command.

Figure 2:
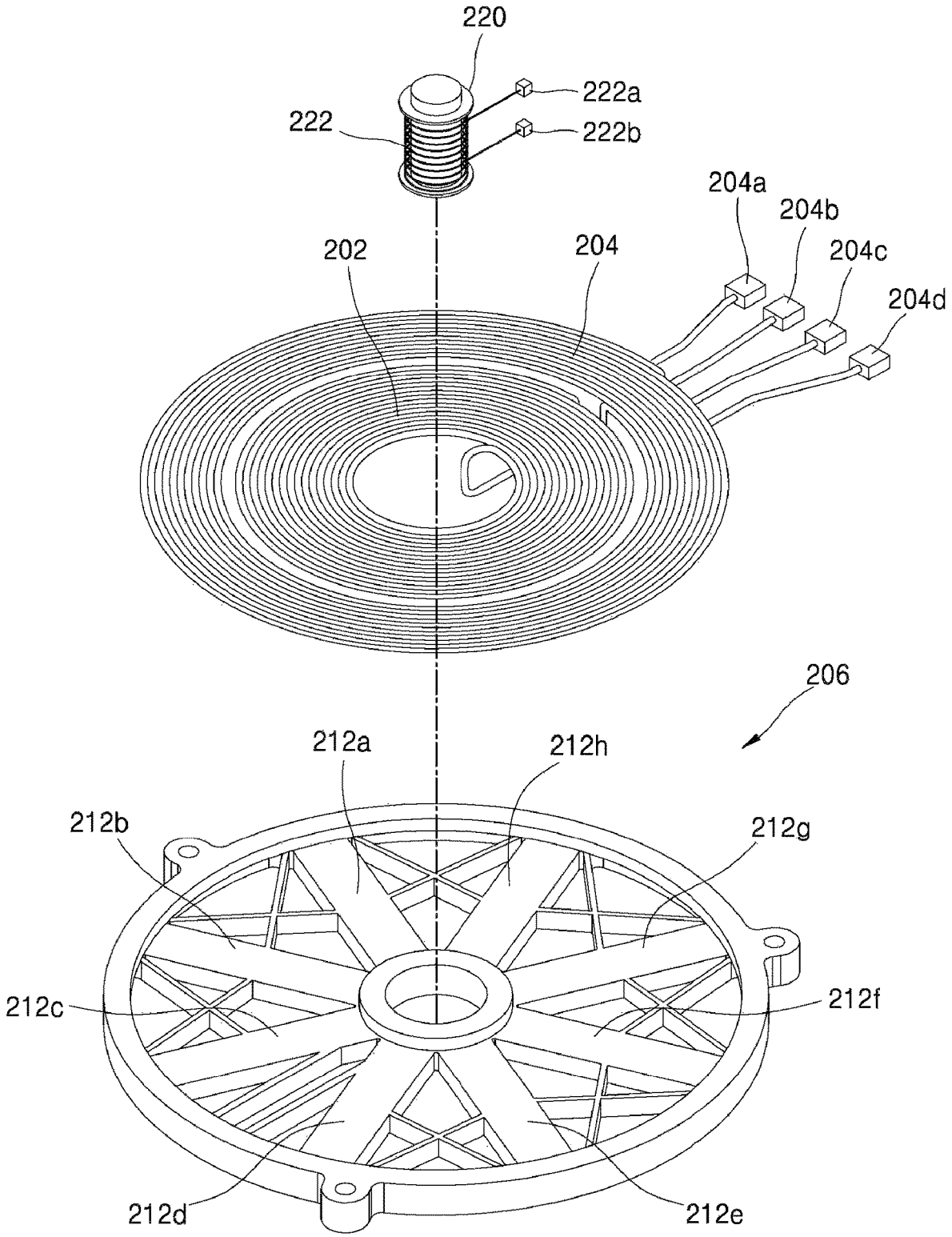
FIG. 2 is a perspective view showing a structure of a working coil assembly included in an induction heating device according to one embodiment of the present disclosure.
Figure 3:
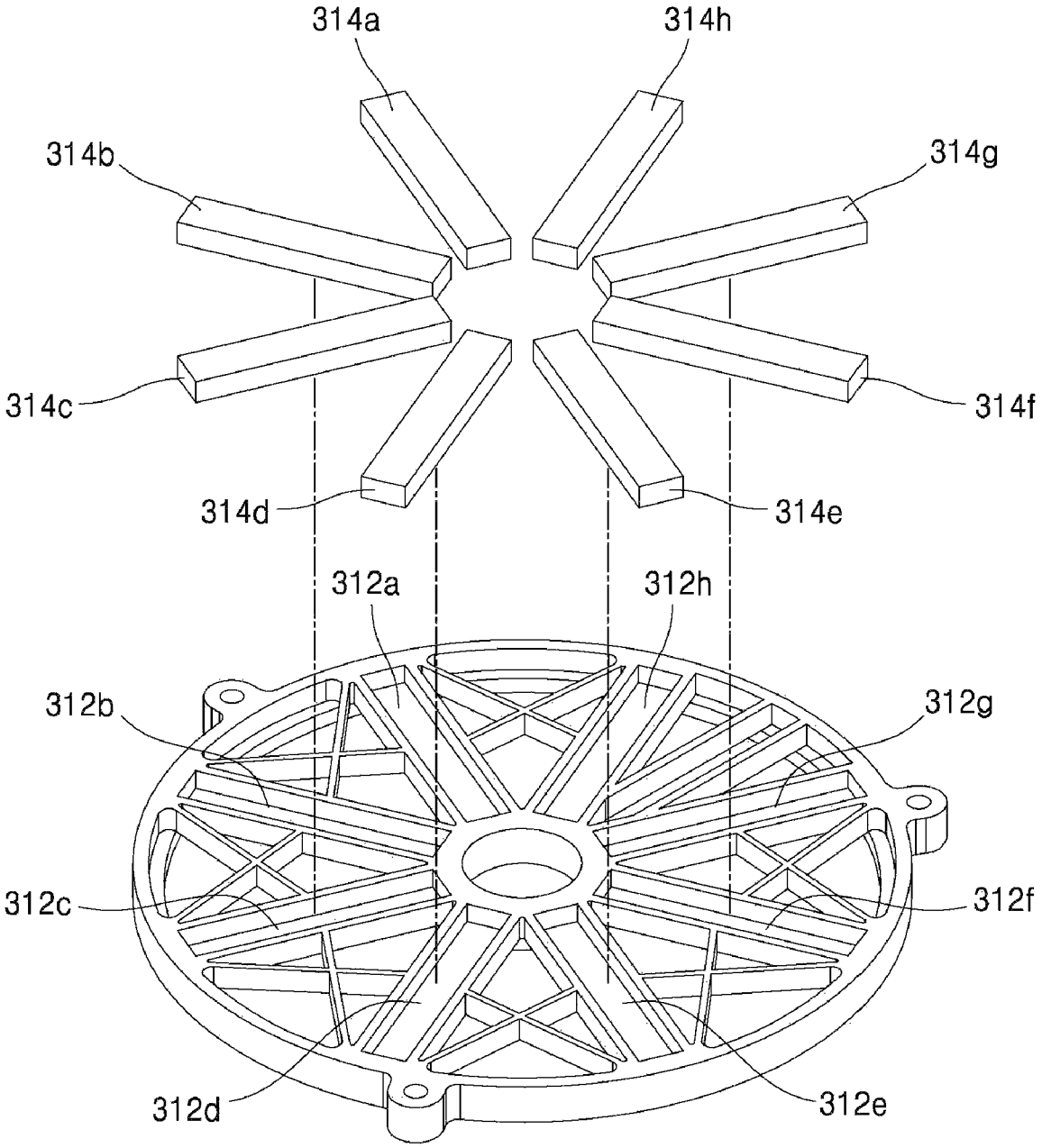
FIG. 3 is a perspective view showing a coil base included in the working coil assembly according to one embodiment of the present disclosure.

Hereinafter, with reference to FIGS. 2 and 3, a structure of the working coil assembly 108, 110 included in the inductively-heated device 10 according to embodiment will be described in detail. For example, FIG. 2 provides a perspective view showing a structure of a working coil assembly included in an induction heating device, and FIG. 3 is a perspective view showing a coil base included in the working coil assembly.

The working coil assembly according to one embodiment of the present disclosure may include a first working coil 202, a second working coil 204, and a coil base 206. The first working coil 202 may be mounted on the coil base 206 and may be wound circularly a first number of times (e.g., a first rotation count) in a radial direction. Furthermore, a second working coil 204 may be mounted on the coil base 206 and may be circularly wound around the first working coil 202 a second number of times (e.g., a second rotation count) in the radial direction. Thus, the first working coil 202 may be located radially inside and at a center of the second working coil 204.

The first rotation count of the first working coil 202 and the second rotation count of the second working coil 204 may vary according to the embodiment. The sum of the first rotation count of the first working coil 202 and the second rotation count of the second working coil 204 may be limited by the size of the coil base 206, and the configuration of the induction heating device 10 and the wireless power transmission device.

Both ends of the first working coil 202 and both ends of the second working coil 204 may extend outside the first working coil 202 and the second working coil 204, respectively. Connectors 204*a* and 204*b* may be respectively connected to the two ends of the first working coil 202, while connectors 204*c* and 204*d* may be connected to the two ends of the second working coil 204, respectively. The first working coil 202 and the second working coil 204 may be electrically connected to the control unit (such as control unit 602) or the power supply (such as power supply 112) via the connectors 204*a*, 204*b*, 204*c* and 204*d*. According to an embodiment, each of the connectors 204*a*, 204*b*, 204*c*, and 204*d* may be implemented as a conductive connection terminal.

The coil base 206 may be a structure to accommodate and support the first working coil 202 and the second working coil 204. The coil base 206 may be made of or include a nonconductive material. In the region of the coil base 206 where the first working coil 202 and the second working coil 204 are mounted, receptacles 212*a* to 212*h* may be formed in a lower portion of the coil base 206 to receive magnetic sheets, such as ferrite sheets 314*a*-314*h* described below.

As shown in FIG. 3, the receptacles 312*a* to 312*h* (corresponding to receptacles 212*a* to 212*h* in FIG. 2) may be formed at lower portions of the coil base 206 to receive and accommodate the ferrite sheets 314*a* to 314*h*. The receptacles 312*a* to 312*h* may extend in the radial direction of the first working coil 202 and the second working coil 204. The ferrite sheets 314*a* to 314*h* may extend in the radial direction of the first working coil 202 and the second working coil 204. In should be appreciated that the number, shape, position, and cross-sectional area of the ferrites sheet 314*a* to 314*h* may vary in different embodiments. Furthermore, although the ferrites sheet 314*a* to 314*h* although designed as "ferrite" may include various non-ferrous materials.

As shown in FIG. 2 and FIG. 3, the first working coil 202 and the second working coil 204 may be mounted on the coil base 206. A magnetic sheet may be mounted under the first working coil 202 and the second working coil 204. This magnetic sheet may prevent the flux generated by the first working coil 202 and the second working coil 204 from being directed below the coil base 206. Preventing the flux from being directed below the coil base 206 may increase a density of the flux produced by the first working coil 202 and the second working coil 204 toward the loaded object.

Meanwhile, as shown in FIG. 2, a loaded-object sensor 220 according to one embodiment of the present disclosure may be provided in the central region of the first working coil 202. In the embodiment of FIG. 2, the loaded-object sensor 220 may be provided concentrically with the first working coil 202, but the present disclosure is not limited thereto. Depending on the embodiment, the position of the loaded-object sensor 220 may vary.

On the outer face of the loaded-object sensor 220, a sensing coil 222 may be wound by a predetermined rotation count. Both ends of the sensing coil 222 may be connected to connectors 222*a* and 222*b*, respectively. The sensing coil 222 may be electrically connected to the control unit (such as control unit 602) or a power supply (such as power supply 112) via the connectors 222*a* and 222*b*. The control unit may manage the power supply to supply current to the sensing coil 222 through the connectors 222*a* and 222*b* of the loaded-object sensor 220 to determine the type of the loaded object, as described below.

Figure 4:
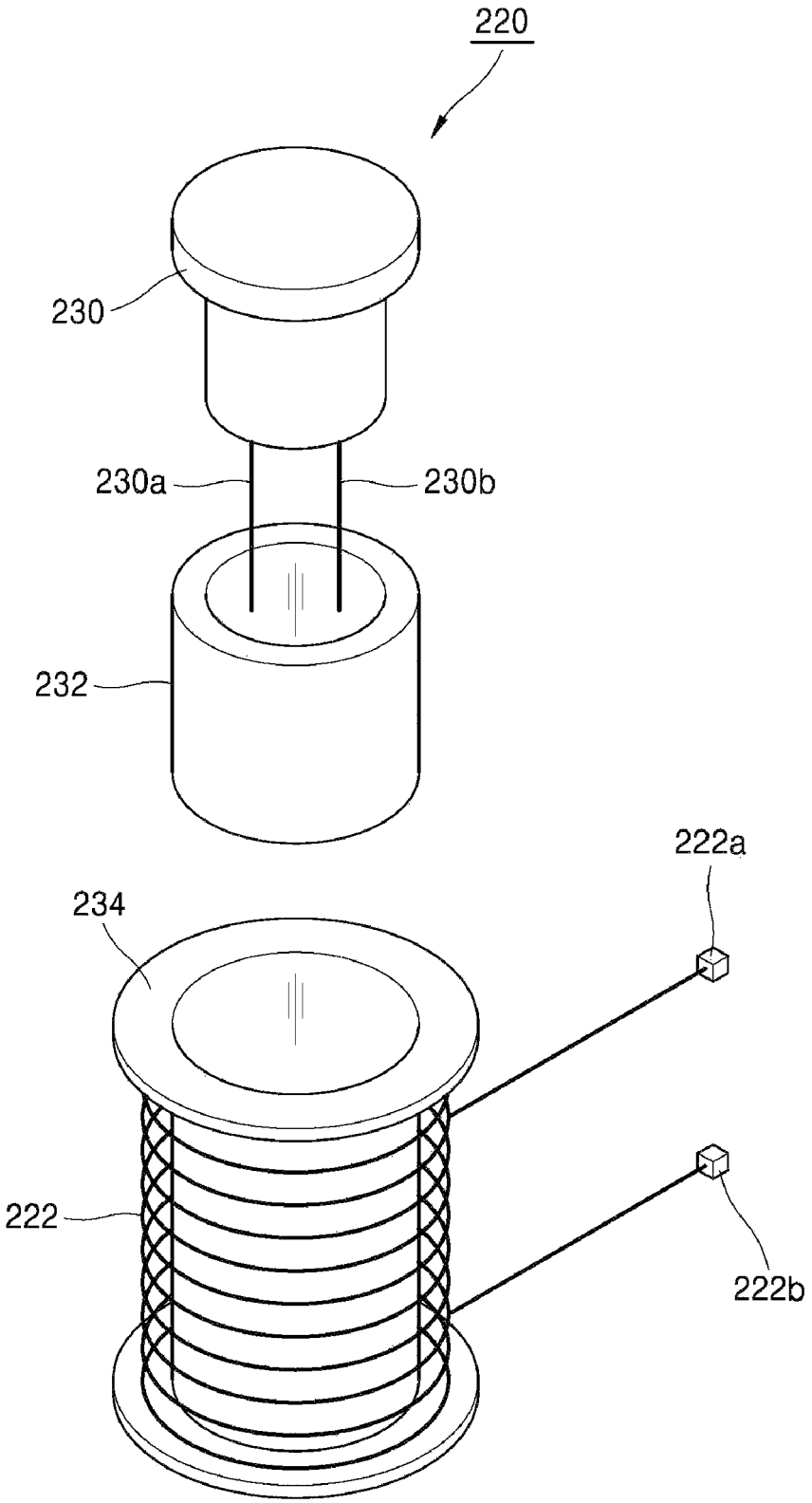
FIG. 4 shows a configuration of a loaded-object sensor according to one embodiment of the present disclosure.

FIG. 4 shows a configuration of a loaded-object sensor 220 according to one embodiment of the present disclosure. Referring to FIG. 4, the loaded-object sensor 220 according to one embodiment of the present disclosure may include a cylindrical hollow body 234. The space formed inside the cylindrical hollow body 234 is defined as a first receiving space.

A sensing coil 222 may be wound by a predetermined winding count around an outer surface of the cylindrical hollow body 234. Both ends of the sensing coil 222 may be connected to connectors 222*a* and 222*b* for electrical connection with other devices. The sensing coil 222 may be electrically connected to a control unit (such as control unit 602) and/or a power supply (such as power supply 112) via the connectors 222*a* and 222*b*.

In one embodiment of the present disclosure, the control unit (such as control unit 602) may determine a type or other attribute of the loaded object. For example, the control unit may determine whether or not the loaded object is suitable for induction heating based on, for example, the change in the inductance value or current phase of the sensing coil 222 when the current is applied to the sensing coil 222 through the power supply.

Furthermore, the loaded-object sensor 220 may include a magnetic core 232 that is received in the first receiving space of the cylindrical hollow body 234 and may have a substantially cylindrical shape. The magnetic core 232 may be made of or otherwise include a material characterized by magnetism, such as ferrite. The magnetic core 232 may increase the density of flux induced in the sensing coil 222 when a current flows through the sensing coil 222. The magnetic core 232 may have a hollow substantially cylindrical shape that includes a second receiving space defined therein.

Within the second receiving space of the magnetic core 232, a temperature sensor 230 may be received. The temperature sensor 230 may be a sensor that measures a temperature of the loaded object. The temperature sensor 230 may include wires 230*a* and 230*b* to provide an electrical connection with other devices, such as to a control unit or a power supply. The wires 230*a* and 230*b* of the temperature sensor 230 may be extend to pass to the outside through an opposite side of the magnetic core 232 and the other side of the cylindrical hollow body 234 through the first and second receiving spaces.

Figure 5:
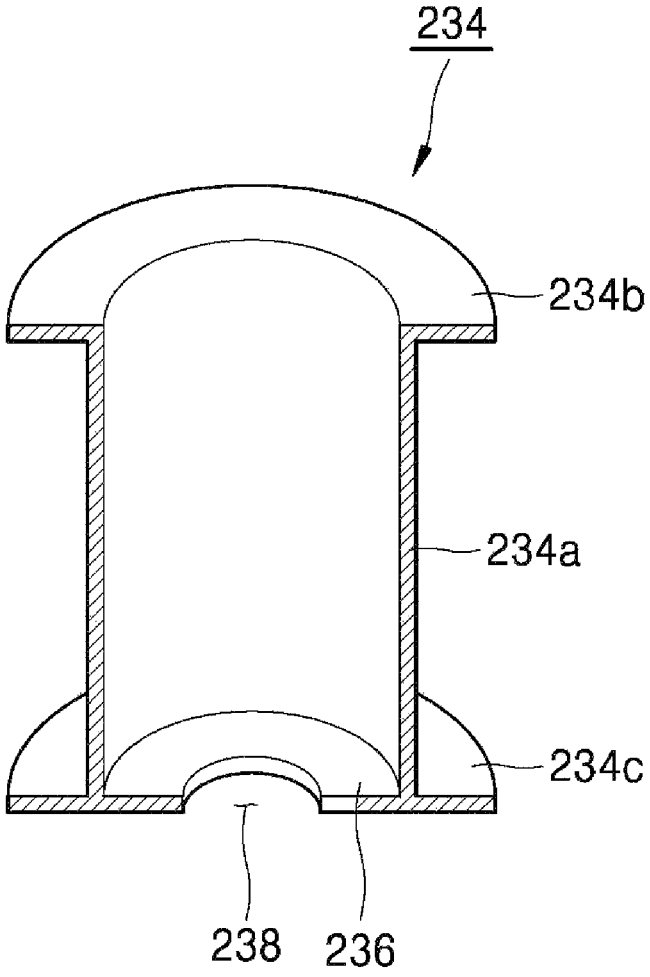
FIG. 5 is a vertical cross-sectional view of a body included in a loaded-object sensor according to one embodiment of the present disclosure.

FIG. 5 is a longitudinal section of the cylindrical hollow body 234 of the loaded-object sensor 220 according to one embodiment of the present disclosure. As shown in FIG. 5, the cylindrical hollow body 234 of the loaded-object sensor 220 may have a cylindrical hollow vertical portion (or cylindrical wall) 234*a*, a first flange 234*b* extending horizontally from the top of the vertical portion 234*a* (or a first axial end adjacent to the loading plate 106), and a second flange 234*c* extending from the bottom of the vertical portion 234*a* (or a second axial end opposite to the loading plate 106).

The first flange 234*b* may extend along the outer face of the upper end of the vertical portion 234*a* so that the magnetic core 232 may be freely moved downward into the first receiving space of the cylindrical hollow body 234. Further, the second flange 234*c* may include a support portion 236 (or internal flange) to support the magnetic core 232 and block further downward motion of the magnetic core 232 when the magnetic core 232 is received into the first receiving space within the cylindrical hollow body 234.

Further, a hole 238 that provides a through passage for the wires 230*a* and 230*b* of the temperature sensor 230 may be defined in the supporting portion 236 of the second flange 234*c*. The wires 230*a* and 230*b* of the temperature sensor may pass through the bottom of the magnetic core 232 and though the hole 238 to extend out of the cylindrical hollow body 234. The wires 230*a* and 230*b* of the temperature sensor 230 that are exposed through the hole 238 may be electrically connected to the control unit (such as control unit 602) or the power supply (such as the power supply 112).

In FIG. 4 and FIG. 5, the temperature sensor 230 and the magnetic core 232 may be vertically inserted in the direction from the first flange 234*b* toward the second flange 234*c* (e.g., downward). However, in another embodiment of the present disclosure, the temperature sensor 230 and the magnetic core 232 may be inserted in a direction upward through the second flange 234*c* and toward the first flange 234*b*. In this configuration, the support portion 236 having the wire hole 238 defined therein may be included in the first flange 234*b*.

As described with reference to FIGS. 4 and 5, the loaded-object sensor 220 according to the present disclosure may determine a type or other attribute of the loaded object using the current flowing in the sensing coil 222, and at the same time, the temperature of the loaded object may be measured using the temperature sensor 230. Because the temperature sensor 230 may be received within the cylindrical hollow body 234, the overall size and volume of the sensor may be reduced, making placement and space utilization thereof within the inductively-heated device more flexible.

Figure 6:
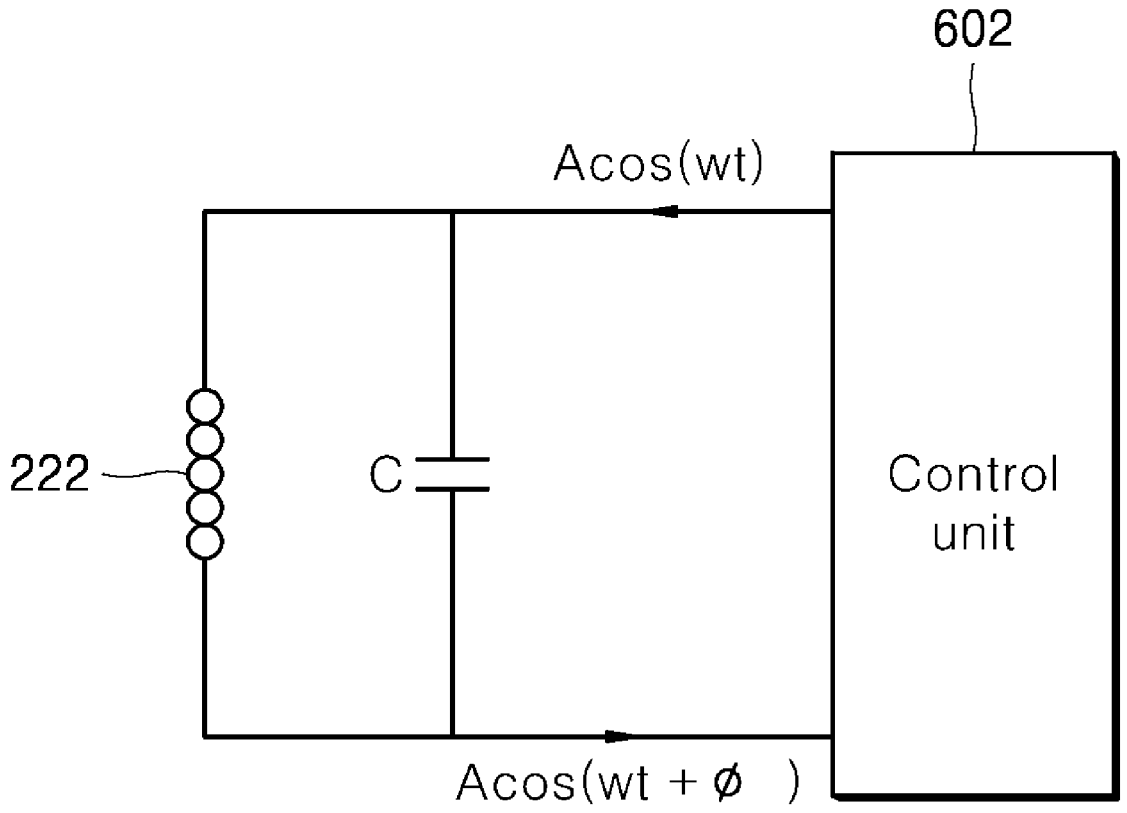
FIG. 6 is a circuit diagram of a loaded-object sensor according to one embodiment of the present disclosure.

FIG. 6 is a circuit diagram of the loaded-object sensor 220 according to one embodiment of the present disclosure. Referring to FIG. 6, a control unit 602 (or controller) according to the present disclosure may manage a power supply (such as power supply 112) to apply an alternating current A cos(ωt) having a predetermined amplitude A and phase value wt to the sensing coil 222 of the loaded-object sensor 220. After applying the alternating current to the sensing coil 222, the control unit 602 may include a sensor to receive the alternating current through the sensing coil 222 and to analyze the components of the received alternating current to determine changes in the attributes of the alternating current through the sensing coil 222, such a phase change or induction.

When there is no loaded object near the sensing coil 222 or the loaded object is not a non-inductive object that does not contain an appropriate metal component, the phase value ωt+φ of the alternating current A cos(ωt+φ) received through the sensing coil 222 does not exhibit a large difference (φ) from the phase value ωt of the alternating current before being applied to the sensing coil 222. This relative lack of a phase change may be interpreted to mean that the inductance value L of the sensing coil 222 does not change since (1) there is no loaded object near the sensing coil 222, or (2) the loaded object does not contain an appropriate metal component and is, thus, non-inductive.

However, if the loaded object in proximity to the sensing coil 222 contains an appropriate metal that is inductive (e.g., includes iron, nickel, cobalt, and/or some alloys of rare earth metals), magnetic and electrical inductive phenomena occur between the loaded object and the sensing coil 222. Therefore, a relatively large change may occur in the inductance value L of the sensing coil 222. Thus, the change in the inductance value L may greatly increase a change φ of the phase value ωt+φ of the alternating current A cos(ωt+φ) received through the sensing coil 222.

Accordingly, the control unit 602 may apply the alternating current A cos(ωt) having a predetermined amplitude A and phase value ωt to the sensing coil 222 of the loaded-object sensor and, then, determine the type of the loaded object close to the working coil 222 based on a difference between the applied input alternating current and the received alternating current from the sensing coil 222. In one embodiment of the present disclosure, the control unit 602 may apply the alternating current A cos(ωt) having a predetermined amplitude A and phase value ωt to the sensing coil 222 of the loaded-object sensor 220, the AC current received through the sensing coil 222 may become the alternating current A cos(ωt+φ) with the phase value ωt+φ. In this context, when the phase change φ for the alternating current A cos(ωt+φ) exceeds a predetermined first reference value, the control unit 602 may determine that the loaded object has an induction heating property. Alternatively, when the phase change φ of the alternating current A cos(ωt+φ) does not exceed the predetermined first reference value, the control unit 602 may determine that the loaded object does not have an induction heating property or no object is positioned on the loading plate 106.

In another embodiment of the present disclosure, the control unit 602 may apply the alternating current A cos(ωt) having a predetermined amplitude A and phase value ωt to the sensing coil 222 of the loaded-object sensor, the control unit may measure an inductance value L of the sensing coil 222. When the measured inductance value L of the sensing coil 222 exceeds a predetermined second reference value, the control unit 602 may determine that the loaded object has an inductive heating property. In this connection, when the measured inductance value L of the sensing coil 222 does not exceed the predetermined second reference value, the control unit 602 may determine that the loaded object does not have an inductive heating property or no object is provided on the loading plate 106.

In this way, when the control unit 602 determines that an object (e.g., cooking vessel) is placed on the loading plate 106 and the loaded object has an inductive heating property, the control unit 602 may perform a heating operation by applying an electric current to the working coils 202, 204 based on, for example, a heating level designated by the user through the interface 114.

During the heating operation, the control unit 602 may measure the temperature of the loaded object being heated using the temperature sensor 230 housed within the loaded-object sensor 220. When controlling the current applied to the working coils 202, 204, the control unit 602 may, for example, apply a particular current level based on the heating level selected by the user when the control unit 602 determined, based on the loaded object sensor 220, that a cooking vessel in positioned on the working coils 202, 204 and has an appropriate induction heating characteristics. The control unit 602 may then determine the temperature of the cooking vessel using the temperature sensor 230 and may modify or stop the current to the working coils 202, 204 based on the detected temperature and the selected heating level, such as to reduce or cease the current when the detected temperature of the cooking vessel equals or exceeds the selected heating level. Similarly, the control unit 602 may determine based on, for example, an attribute of a received current from the sensing coil 222 of the loaded object sensor 220, when the cooking vessel is removed from the working coils 202, 204, and may stop the current to the working coils 202, 204.

When the loaded object sensing is performed using the loaded-object sensor 220 according to the present disclosure, the power supplied to the sensing coil 222 for the loaded object sense may typically be less than 1 W since the sensing coil 222 is relatively small and generates a relatively small magnetic field. The magnitude of this power for the sensing coil 222 is very small compared to the power conventionally supplied to the working coil of the working coil assembly 108, 110 (over 200 W) when sensing a presence and composition of loaded object sense.

In one embodiment of the present disclosure, the control unit 602 may be programmed to apply repeatedly the alternating current to the sensing coil 222 at a particular time interval (e.g., 1 second, 0.5 second, or other interval) to determine whether a loaded object on the induction heating device 10 has an inductive heating property (e.g., has an appropriate material and physical shape to be heated by flux from a generated inductive magnetic field). The control unit 602 may analyze the resulting output current (e.g., the phase and/or induction changes) to determine a presence and composition of the loaded object. When the control unit 602 performs such repetitive current application and output current analysis, the type and presence of the loaded object may be determined in near real time (e.g., within the testing interval) by the control unit 602 whenever the user places the object on or removes the object from the induction heating device 10 after the power is applied to the induction heating device 10.

Further, according to the configuration of the loaded-object sensor 222 and the working coils 202, 204 according to the embodiment of the induction heating device 10 as described above with reference to FIGS. 1 to 5, the sensing coil may be placed in a central area within the working coils 202, 204. Accordingly, the sensing coil 222 and the working coils 202, 204 may be adjacent to each other. Due to such proximity, when a current for heating operation is applied to the working coils 202 and 204, an induced voltage may be generated in the sensing coil 222 by the magnetic force generated by the current applied to the working coil 202, 204. Due to such induced voltage, there is a possibility that a component or an element electrically connected to the sensing coil 222 may malfunction or be damaged.

Figure 7:
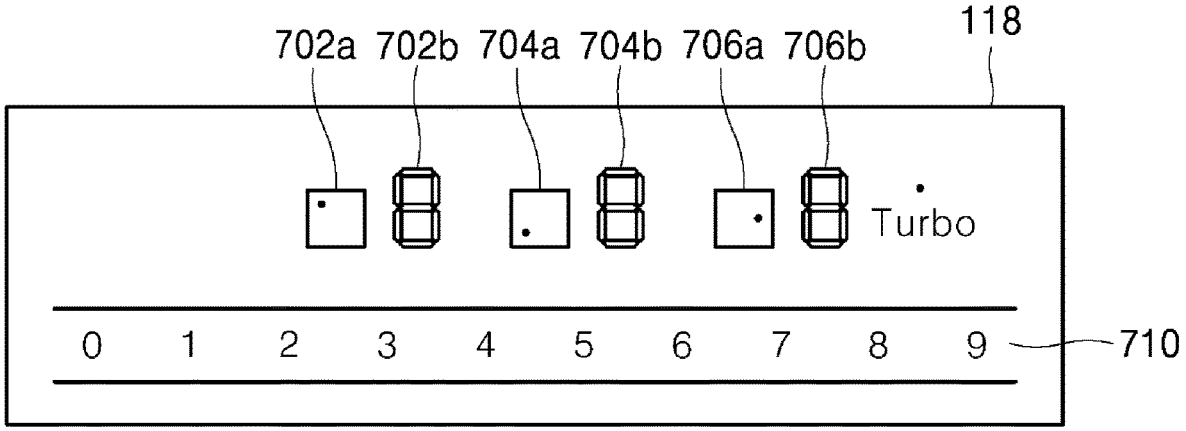
FIG. 7 shows a manipulation region of the induction heating device according to one embodiment of the present disclosure.

FIG. 7 shows one embodiment of the manipulation region 118 located in the loading plate 106 of FIG. 1 as described above. As shown in FIG. 7, the manipulation region 118 may include heating-region selection buttons 702*a*, 704*a*, and 706*a* that respectively indicate positions of heating-regions included in the induction heating device on the loading plate 106. The manipulation region 118 may include a heating power selection button (or heating power selection region) 710 that controls a quantity of heating power associated with each heating region. The heating power selection button 710 may include number 1 through 10 corresponding to ranges of induction current applied to an associated one of the working plates, such as 1 corresponding to 10% of a maximum induction current, 2 corresponding to 20% of the maximum induction current, etc. In FIG. 7, information about the three heating-regions may be displayed in the manipulation region 118, but the present disclosure is not limited thereto. The number of heating-regions included in the induction heating device 10 may vary depending on the embodiment and design of the induction heating device 10.

Further, current heating powers of the corresponding heating-regions may be respectively indicated by corresponding numbers in heating power display regions 702*b*, 704*b*, and 706*b*. Further, the manipulation region 118 may include a turbo display region that when a particular heating-region is rapidly heated.

According to certain situations, the user may place the loaded-object on one of the three heating-regions, for example, on the second heating-region. The user then touches the second heating-region selection button 704*a*. The user then inputs the heating power to be applied to the loaded-object placed on the corresponding heating-region via the touch of the heating power selection button 710. The induction heating device 10 may then determine whether the loaded-object on the second heating-region selected by the user has an inductive heating property (e.g., based on analyzing a current applied to the sensor coil 222). When the corresponding loaded-object has an inductive heating property, the induction heating device 10 may apply a current to a working coil 202, 204 corresponding to a corresponding heating-region to perform a heating operation to achieve the heating power designated by the user for the loaded object.

In this context, when the loaded-object placed in the second heating-region has an inductive heating property, the heating power input by the user through the heating power selection button 710 is displayed as a number in the heating power display region 704*b* corresponding to the second heating-region. Conversely, when the loaded-object placed in the second heating-region does not have the inductive heating property (e.g., does not include a ferrous metal base), the heating power display region 704*b* corresponding to the second heating-region may be marked with a number or letter (e.g., u) to indicate that the corresponding loaded-object is a non-inductive heating loaded-object and/or that no current is being applied to the working coil 202, 204.

Eventually, after the user places the loaded-object in a certain heating-region, the user may specify the specific heating region to be heated via the touch of the loaded-object selection button. As described above, according to the present disclosure, a current may be applied to the sensing coil 222 of the loaded-object sensor repeatedly at a predetermined time interval (for example, 1 second or 0.5 seconds), and, thus, the type of the loaded-object is determined based on the result of the current application to the sensing coil 222. In this configuration, when the user places the loaded-object in any heating-region, the type of the loaded-object may be determined substantially immediately after the predetermined time interval elapses.

In one example, when the user places the object with inductive heating properties on the second heating-region, the induction heating device 10 may not wait for the user to input the heating-region selection buttons 702*a*, 704*a*, or 706*a*, but instead, may indicate that the second heating-region is available on the heating power display region 704*b* corresponding to the second heating-region using a character or number (e.g., 0). When such a letter or number is displayed, the user may input a heating power to be applied to the corresponding heating-region via the touch of the heating power selection button 710. Then, the heating power input may be displayed substantially immediately in the heating power display region 704*b*. The induction heating device may then apply a current to the working coil 202, 204 so that the heating power of the corresponding heating-region reaches the desired heating power corresponding to the input by the user.

When the user places a non-inductive heating loaded-object on one of the regions (e.g., the second heating-region), a number or letter (e.g., u) to indicate that the corresponding loaded-object cannot be heated through induction, according to the loaded-object determination process as described above, may be displayed in the heating power display region 704*b* corresponding to the region where the object is placed.

Eventually, according to aspects of the present disclosure, after the user places an object with inductive heating properties on any heating-region, the user may immediately enter the desired heating power and start the heating operation without having to press the heating-region selection button 702*a*, 704*a*, or 706*a*. For example, the induction heating device 10 according to the present disclosure may eliminate the input operation for selecting the heating region from the user.

Further, according to aspects of the present disclosure, when the user places a loaded object on any heating-region, the induction heating device may display, on each heating power display region, within a relatively short period of time, whether the corresponding loaded object has an inductive heating property. Therefore, the user may intuitively and quickly verify whether the loaded object is compatible with the induction heating device 10.

The aspects of the present disclosure provide a loaded-object sensor capable of accurately and quickly discriminating the type of the loaded-object while consuming less power than a conventional one, and to provide an induction heating device including the loaded-object sensor. Further, aspects of the present disclosure provide a loaded-object sensor configured to simultaneously perform temperature measurement of the loaded-object and determination of the type of the loaded-object, and to provide an induction heating device including the loaded-object sensor.

The aspects of the present disclosure are not limited to the above-mentioned aspects. Other aspects of the present disclosure, as not mentioned above, may be understood from the foregoing descriptions and more clearly understood from the embodiments of the present disclosure. Further, it will be readily appreciated that the aspects of the present disclosure may be realized by features and combinations thereof as disclosed in the claims.

The aspects of present disclosure provide an induction heating device with a loaded-object sensor for accurately determining a type of the loaded-object while consuming less power than in the prior art. The loaded-object sensor according to the present disclosure may have a cylindrical hollow body with a sensing coil wound on an outer face thereof. Further, a temperature sensor is accommodated in a receiving space formed inside the body of the loaded-object sensor. The loaded-object sensor having such a configuration may be provided in a central region of the working coil and concentrically with the coil. The sensor may determine the type of loaded-object placed at the corresponding position to the working coil and at the same time, measure the temperature of the loaded-object.

In particular, the sensing coil included in the loaded-object sensor according to the present disclosure may have fewer rotation counts and a smaller total length than those of the working coil. Accordingly, the sensor according to the present disclosure may identify the type of the loaded-object while consuming less power as compared with the discrimination method of the loaded-object using a working coil.

Further, as described above, the temperature sensor may be accommodated in the internal space of the loaded-object sensor according to the present disclosure. Accordingly, the temperature may be measured and the type of the loaded-object may be determined at the same time by using the sensor having a relatively smaller size and volume.

In accordance with a first aspect of the present disclosure, there is provided a loaded-object sensor that may include: a cylindrical hollow body having a first receiving space defined therein; and a hollow cylindrical magnetic core received in the first space, wherein the hollow magnetic core has a second receiving space defined therein; and a sensing coil wound on an outer face of the body by predetermined winding counts. The loaded-object sensor may be controlled by a control unit.

In one embodiment of the first aspect, the loaded-object sensor may further include a temperature sensor received in the second receiving space. In one embodiment of the first aspect, the cylindrical hollow body may have a support bottom to support the magnetic core. In one embodiment of the first aspect, the support bottom may have wire hole defined therein, wherein a wire connected to the temperature sensor in the second receiving space may pass through the hole and out of the body.

In one embodiment of the first aspect, when a current is applied to the sensing coil and, then, a phase value of a current measured from the sensing coil exceeds a predetermined first reference value, the control unit may determine that the loaded-object has an inductive heating property. In another embodiment of the first aspect, when a current is applied to the sensing coil and, then, an inductance value measured from the sensing coil exceeds a predetermined second reference value, the control unit may determine that the loaded-object has an inductive heating property.

Further, in accordance with a second aspect of the present disclosure, an induction heating device may comprise: a loading plate on which a loaded-object is placed; a working coil provided below the loading plate for heating the loaded-object using an inductive current; a loaded-object sensor provided concentrically with the working coil, wherein the sensor includes a sensing coil, wherein the sensing coil inductively reacts with the loaded-object with an inductive heating property; and a control unit configured for determining, based on the sensing result of the loaded-object sensor, whether the loaded-object has an inductive heating property, wherein the loaded-object sensor may include: a cylindrical hollow body having a first receiving space defined therein; and a hollow cylindrical magnetic core received in the first space, wherein the hollow magnetic core has a second receiving space defined therein; and the sensing coil wound on an outer face of the body by predetermined winding counts.

In one embodiment of the second aspect, the loaded-object sensor may further include a temperature sensor received in the second receiving space. In one embodiment of the second aspect, the cylindrical hollow body may have a support bottom to support the magnetic core. In one embodiment of the second aspect, the support bottom may have a wire hole defined therein, wherein a wire connected to the temperature sensor in the second receiving space passes through the hole out of the body. In one embodiment of the second aspect, the induction heating device may further comprise a coil base to fix the working coil thereto.

In one embodiment of the second aspect, when a current is applied to the sensing coil and, then, a phase value of a current measured from the sensing coil exceeds a predetermined first reference value, the control unit may determine that the loaded-object has an inductive heating property. In one embodiment of the second aspect, when a current is applied to the sensing coil and, then, an inductance value measured from the sensing coil exceeds a predetermined second reference value, the control unit may determine that the loaded-object has an inductive heating property.

In accordance with aspects of the present disclosure, the loaded-object sensor may accurately and quickly discriminate a type of the loaded-object while consuming relatively less power. Further, in accordance with aspects of the present disclosure, the loaded-object sensor may simultaneously perform temperature measurement of the loaded-object and determination of the type of the loaded-object.

In the above description, numerous specific details are set forth in order to provide a thorough understanding of the present disclosure. The present disclosure may be practiced without some or all of these specific details. Examples of various embodiments have been illustrated and described above. It will be understood that the description herein is not intended to limit the claims to the specific embodiments described. On the contrary, it is intended to cover alternatives, modifications, and equivalents as may be included within the spirit and scope of the present disclosure as defined by the appended claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An induction heating device comprising:
- a loading plate;
- a working coil provided to heat a cooking vessel on the loading plate using an inductive current;
- a sensor provided concentrically within the working coil, wherein the sensor includes:
  - a cylindrical body having a first receiving space defined therein;
  - a cylindrical magnetic core received in the first space, wherein the magnetic core has a second receiving space defined therein; and
  - a sensing coil wound on an outer face of the body by a first winding count;
- a temperature sensor received and fixed in the second receiving space to detect a temperature of the cooking vessel; and
- a controller that determines, based on applying a sensing current to the sensing coil, when the cooking vessel is on the loading plate and whether the cooking vessel has an inductive heating property to determine whether the cooking vessel is suitable for induction heating.

2. The induction heating device of claim 1, wherein the cylindrical hollow body has an internal flange to support the magnetic core.

3. The induction heating device of claim 2, wherein the internal flange has a wire hole defined therein, and a wire connected to the temperature sensor in the second receiving space passes through the wire hole and out of the body.

4. The induction heating device of claim 1, wherein when a phase change measured in the sensing current applied to the sensing coil exceeds a reference value, the controller determines that the cooking vessel has the inductive heating property.

5. The induction heating device of claim 1, wherein the controller further:
- measures an inductance value associated with the sensing current applied to the sensing coil, and
- when the inductance value exceeds a reference value, determines that the cooking vessel has the inductive heating property.

6. The induction heating device of claim 1, further comprising a coil base to fix the working coil thereto.

7. The induction heating device of claim 1, wherein the sensing current applied to the sensing coil for sensing the cooking vessel is smaller than the induction current applied to the working coil for heating the cooking vessel.

8. The induction heating device of claim 1, wherein the working coil is wound by a second winding count that is greater than the first winding count of the sensing coil.

9. The induction heating device of claim 1, further comprising:
- a display to provide an indication of whether the cooking vessel has the inductive heating property.

10. An induction heating device comprising:
- a loading plate;
- a working coil provided to heat a cooking vessel on the loading plate using an inductive current;
- a cylindrical body having a first receiving space defined therein, the body being positioned in the working coil;

a sensing coil wound on an outer face of the body by a first winding count that is smaller than a second winding count for the working coil;

a temperature sensor received and fixed in the body to detect a temperature of the cooking vessel; and a controller that determines, based on applying a sensing current to the sensing coil, whether the cooking vessel has an inductive heating property to determine whether the cooking vessel is suitable for induction heating.

11. The induction heating device of claim 10, further comprising:

a cylindrical magnetic core received in the first receiving space, wherein the magnetic core has a second receiving space in which the temperature sensor is received.

12. The induction heating device of claim 11, wherein the cylindrical hollow body has an internal flange to support the magnetic core.

13. The induction heating device of claim 12, wherein the internal flange has a wire hole defined therein, and a wire connected to the temperature sensor in the second receiving space passes through the wire hole and out of the body.

14. The induction heating device of claim 10, wherein when a phase change measured in the sensing current applied to the sensing coil exceeds a reference value, the controller determines that the cooking vessel has the inductive heating property.

15. The induction heating device of claim 10, wherein the controller further:

measures an inductance value associated with the sensing current applied to the sensing coil, and when the inductance value exceeds a reference value, determines that the cooking vessel has the inductive heating property.

16. The induction heating device of claim 10, wherein the sensing current applied to the sensing coil for sensing the cooking vessel is smaller than the induction current applied to the working coil for heating the cooking vessel.

17. The induction heating device of claim 10, further comprising:

a display to provide an indication of whether the cooking vessel has the inductive heating property.

18. The induction heating device of claim 17, wherein the display further provides an indication of a level of induction applied by the working coil to the cooking vessel.

19. The induction heating device of claim 10, wherein the inductive heating property indicates whether the cooking vessel is positioned on the loading plate and includes a material that forms an eddy current based on the induction current in the working coil.

20. The induction heating device of claim 10, further comprising a capacitor connected in parallel with the sensing coil.

* * * * *